United States Patent [19]

Pochmarski et al.

[11] Patent Number: 4,525,211

[45] Date of Patent: Jun. 25, 1985

[54] PROCESS FOR PRODUCING A MICROKILLED STEEL SUITABLE FOR FREERUN CONTINUOUS CASTING FOR SUBSEQUENT COLD FORMING

[75] Inventors: Luzian Pochmarski; Otto Köller, both of Leoben; Karl Abendstein, Trofaiach, all of Austria

[73] Assignee: Voest-Alpine Aktiengesellschaft, Linz, Austria

[21] Appl. No.: 620,921

[22] Filed: Jun. 15, 1984

[30] Foreign Application Priority Data

Jun. 16, 1983 [AT] Austria ..... 2219/83

[51] Int. Cl.[3] ..... C21C 7/02

[52] U.S. Cl. ..... 75/58; 75/53; 75/57

[58] Field of Search ..... 75/53, 58, 57

[56] References Cited

U.S. PATENT DOCUMENTS 3,702,243 11/1972 Miltenberger ..... 75/57

3,711,277 1/1973 von Bogdandy ..... 75/57

*Primary Examiner*—Peter D. Rosenberg

*Attorney, Agent, or Firm*—Cushman, Darby & Cushman

[57] ABSTRACT

In order to produce a microkilled steel suitable for freerun continuous casting for subsequent cold forming standardizing of the C - content to ≦0.05%, preferably ≦0.03%, Si - content to ≦0.05%, preferably 0.02–0.04%, and Al - content to ≦0.006% is proposed. For the equivalent carbon content a value ≦0.14%, preferably 0.10–0.12% is standardized using the correlation $$C_{eq} = \%C + 1/7\%Si + 1/5\%Mn + 1/7\%Cr + 1/20\%Ni + 1/9\%Cu + \tfrac{1}{2}\%\ Mo + \tfrac{1}{2}\%\ V$$

for determining the equivalent carbon content. Preferably, the steel is refined in a bottom blowing or bottom rinsing converter and after standardizing the Si - content and/or Mn - content, oxygen activity $a_{[o]}$ is measured and standardized to 60–150 ppm by adding a corresponding amount of an additional deoxidant, particularly aluminum.

12 Claims, 1 Drawing Figure

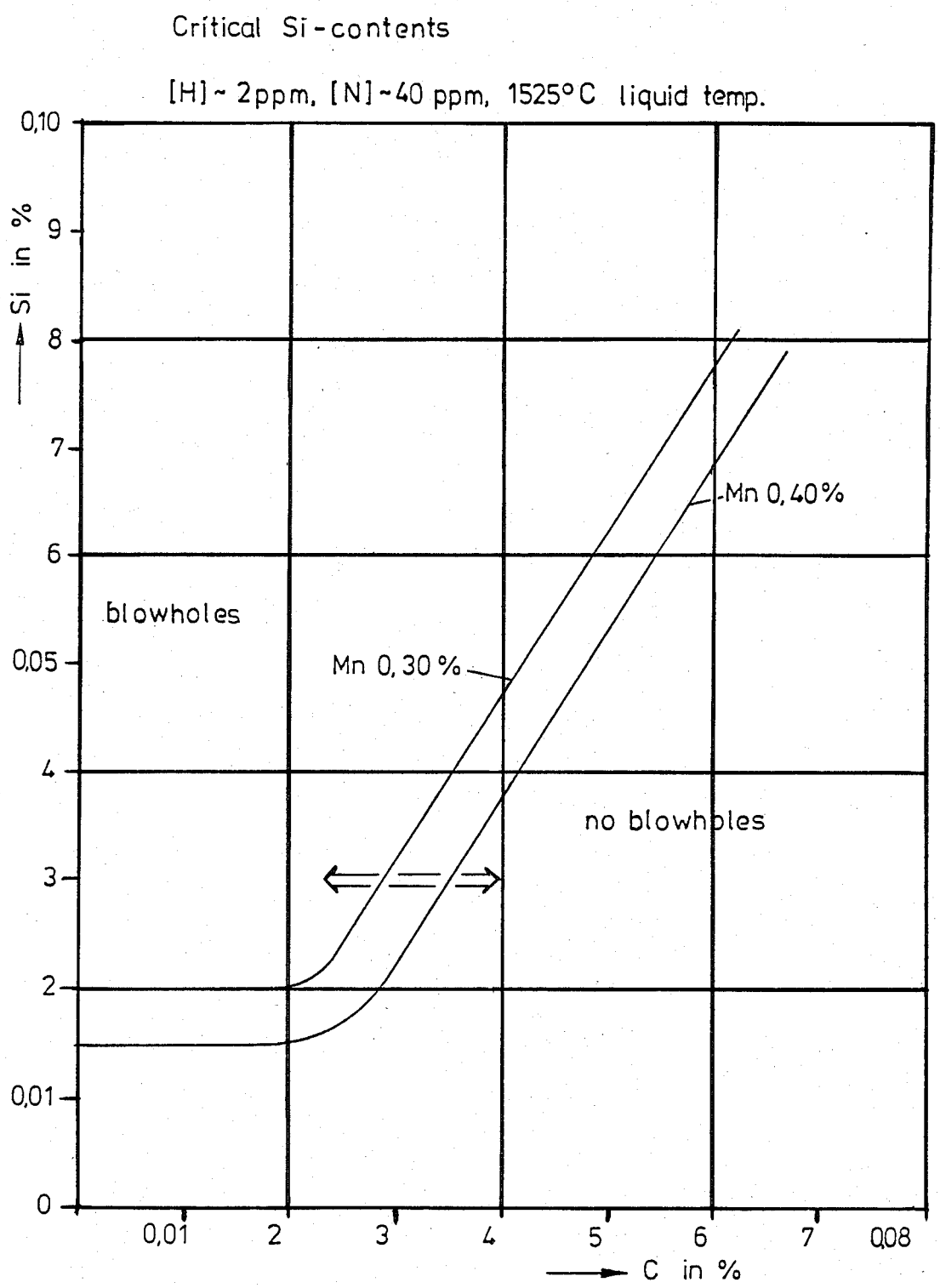
Critical Si-contents
[H] ~ 2ppm, [N] ~ 40 ppm, 1525°C liquid temp.
Si in %
0,10
9
8
7
6
0,05
4
3
2
0,01
0
blowholes
Mn 0,30 %
Mn 0,40 %
no blowholes
0,01
2
3
4
5
6
7
0,08
C in %

PROCESS FOR PRODUCING A MICROKILLED STEEL SUITABLE FOR FREERUN CONTINUOUS CASTING FOR SUBSEQUENT COLD FORMING

The invention relates to a process for producing a microkilled steel suitable for free-run continuous casting for subsequent cold forming, particularly for drawing wires.

In order to achieve good cold-workability rimmed low carbon steel is usually chosen as starting material. Such rimmed low carbon steels permit a ductility up to 99% of deformation and such a rimmed steel is definitely superior in its cold-workability to a steel killed with aluminium or else with silicon as well as to the different types of semikilled steels. Killed steels tend to be hard from the beginning or to show a greater strain-hardening after drawing depending on the choice of the deoxidant. In order to achieve good castability and stretchability until now it was possible only to treat the steel in vacuo which required exceedingly expensive apparatus. With such a killing in vacuo most of the oxygen could be removed and with these measures the disadvantages of rimmed steels in casting could be eliminated to a large extent.

Rimmed steels which would actually be more suitable to subsequent cold-forming have the disadvantage in casting that great non-metallic inclusions and segregation points in the ingot-head can occur which detract from the usability of such a steel. The use of manganese as killing agent may be suitable for the improvement of castability because of the increase of hardness entailed by this measure, but involves a deterioration of stretchability.

The invention aims at developing a process for producing a steel preserving the advantages of killed steels in continuous casting without the need of expensive killing processes in vacuo, simultaneously achieving good stretchability or cold-workability. In order to solve this problem the invention consists essentially in standardizing the carbon content to $\leqq 0.05\%$, preferably $\leqq 0.03\%$, the silicon content to $\leqq 0.05\%$, preferably $\leqq 0.02$–$0.04\%$, and the aluminium content to $\leqq 0.006\%$, wherein the equivalent carbon content is standardized to $\leqq 0.14\%$, preferably 0.10–0.12%, according to the correlation $$C_{eq} = \%C + 1/7\%Si + 1/5\%Mn + 1/7\%Cr + 1/20\%Ni + 1/9\%Cu + \tfrac{1}{2}\%Mo + \tfrac{1}{2}\%V.$$

Thus wire ductilities are achieved which suggest properties equal to those of rimmed soft steel without detracting from castability in free-run continuous casting. The requirements to be met by these wire stretchabilities concerning low carbon, silicon, aluminium, nitrogen contents and impurities increasing hardness such as chromium, nickel and copper as well as preferably low perlite contents and great ferrite grains ensure low resistance to deformation, great ductility and low cold-work hardening thus achieving good stretchability and suitability to cold upsetting. By standardizing the carbon content to less than 0.05%, preferably less than 0.03%, the tendency to form gas pockets in continuous casting is diminished and a lower cold-work hardening is achieved. In just the same way standardizing the silicon content to less than $\leqq 0.05\%$, preferably 0.02–0.04% is responsible for diminishing the tendency of cold-work hardening and hardness of starting material. Standardizing the aluminium content to less than 0.006% aims at excluding the separation of aluminium nitride which would cause a reduction of grain size. Lower phosphorus, nitrogen, chromium, nickel, and copper contents diminish the tendency to cold-work hardening and wire rod hardness is actually reduced. Complying with the carbon equivalent $$C_{eq} = \%C + 1/7\%Si + 1/5\%Mn + 1/7\%Cr + 1/20\%Ni + 1/9\%Cu + \tfrac{1}{2}\%Mo + \tfrac{1}{2}\%V$$

of max. 0.14%, and preferably 0.10 to 0.12%, a grain size of 15 to 20 μm and a perlite content of $\leqq 0.007\%$ is achieved. Such a steel can be cast continuously without necessity of further protective measures and shows with diameters of 5.5 to 13 mm an initial hardness of $\leqq 360 N/mm^2$, proof stress $\leqq 280 N/mm^2$, extension $\geqq 20\%$ and constriction $\geqq 80\%$. The maximum inclusion size in the wire was determined to be $\leqq 4$ according to test specification for steely iron 1570, wherein plastic manganese silicates with a maximum length of 20 μm were concerned.

In contrast to that the production of wires from starting material for ingot-casting involves greater non-homogeneities and inclusion sizes of wires produced from starting material for ingot casting are considerably greater. Particularly in wires drawn from the material from the bottom of the ingot inclusion sizes of 50 to 100 μm were found and behaviour towards deformation of these nonmetallic inclusions which are formed in non-killed ingot casting is essentially more unfavourable. Hardening by drawing of the starting material produced according to the invention corresponds practically to the values resulting from material of rimmed steel.

A steel with the composition according to the invention for achieving the required behaviour towards drawing could until now be produced only by treatment in vacuo in order to standardize low carbon contents and by killing in vacuo. As opposed to that the low carbon content can be achieved most preferably according to the invention by refining the steel in a bottom blowing or bottom rinsing converter.

Following the tapping the steel is according to the invention subject to a conditioning treatment, the standardizing of the silicon and manganese contents being effected depending on the achieved final carbon content. Most preferably the procedure is such as to subject the steel after refining to a conditioning in which the silicon and the manganese contents are standardized to a sum of $\%Si + 0.1\%Mn = 1.53\%C + 0.012$, particularly by adding silicon, depending on the $C_{eq}$-content at values of $C_{eq} \geqq 0.025\%$.

The residual oxygen content can be determined by measuring the oxygen activity and be corrected by controlled adding in the ladle. For this the procedure is preferably such as to measure the oxygen activity $a_{[o]}$ after standardizing the silicon and/or manganese content and to standardize it to 60–150 ppm by adding a corresponding amount of an additional deoxidant, particularly aluminium. By proceeding thus clogging in free-run casting can be avoided and a steel castable continuously without blowholes can be achieved.

In the diagram the process according to the invention is explained more precisely. The conditions to be observed within the scope of the invention, particularly the critical silicon contents for achieving the required properties, can be taken definitely from the diagram.

For equivalent carbon contents >0.025% the curve sketched in the diagram change into straight-lined parallel graphs, each curve being applicable for the manganese content indicated respectively. For the carbon content achieved correspondingly after refining a steel the composition of which can be gathered from the curve on the right side from the corresponding manganese curve must be achieved by adding silicon thus avoiding blowholes in casting. Complying with these conditions the steel can be cast without blowholes and in contrast to steels killed in vacuo as good stretchability as of these is ensured.

What is claimed is:

1. A process for producing a microkilled steel suitable for free-run continuous casting for subsequent cold forming, said process comprising standardizing the carbon content of a carbon-containing steel to ≦0.05%, the silicon content to ≦0.05%, the aluminium content to ≦0.006%, the equivalent carbon content being standardized to ≦0.14% according to the equation $C_{eq}$=%C+1/7%Si+1/5%Mn+1/7%Cr+1/20-%Ni+1/9%Cu+½%Mo+½%V.

2. A process according to claim 1 wherein the steel is refined in a bottom blowing or bottom rinsing converter.

3. A process according to claim 1 wherein subsequent to refining the steel is subject to conditioning in which the silicon content and the manganese content are standardized to a sum of %Si+0.1%Mn=1.53%C+0.012, depending on the $C_{eq}$-content at values of $C_{eq}$≧0.025%.

4. A process according to claim 3 including, after standardizing the silicon content, the step of measuring the oxygen activity a and standardizing same to 60–150 ppm by adding an additional deoxidant.

5. A process as in claim 1 wherein the carbon-containing steel is a rimmed low carbon steel.

6. A process as in claim 1 wherein the carbon content is standardized to ≦0.03%.

7. A process as in claim 1 wherein the silicon content is standardized to 0.02–0.04%.

8. A process as in claim 1 wherein the equivalent carbon content is standardized to 0.10–0.12%.

9. A process as in claim 3 wherein the conditioning step is carried out by adding silicon.

10. A process as in claim 4 wherein the additional deoxidant is aluminum.

11. A process as in claim 4 including, after standardizing the manganese content, the step of measuring the oxygen content and standardizing same by adding an additional deoxidant.

12. A process as in claim 11 wherein the additional deoxidant is aluminum.

* * * * *